US007819555B2

(12) United States Patent
Yu

(10) Patent No.: US 7,819,555 B2
(45) Date of Patent: Oct. 26, 2010

(54) STREET LAMP

(75) Inventor: Sheng-Jung Yu, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 205 days.

(21) Appl. No.: 12/198,281

(22) Filed: Aug. 26, 2008

(65) Prior Publication Data

US 2009/0185376 A1 Jul. 23, 2009

(30) Foreign Application Priority Data

Jan. 23, 2008 (CN) ..... 2008 1 0300192

(51) Int. Cl.
*F21V 33/00* (2006.01)
*G08B 13/194* (2006.01)

(52) U.S. Cl. ..... 362/253; 362/234; 362/431; 348/151

(58) Field of Classification Search ..... 362/253, 362/800, 234, 431, 432; 348/151, 142, 143
See application file for complete search history.

(56) References Cited

U.S. PATENT DOCUMENTS 6,784,357 B1 * 8/2004 Wang ..... 162/244
7,059,096 B2 * 6/2006 Kuebler et al. ..... 52/838
7,137,605 B1 * 11/2006 Guertler ..... 248/214
7,327,281 B2 * 2/2008 Hutchison ..... 340/907
2002/0154218 A1 * 10/2002 Loyd et al. ..... 348/151
2003/0233806 A1 * 12/2003 Kuebler et al. ..... 52/726.4
2008/0043098 A1 * 2/2008 Leblanc ..... 348/113

* cited by examiner

*Primary Examiner*—Bao Q Truong
(74) *Attorney, Agent, or Firm*—Andrew C. Cheng

(57) ABSTRACT

A street lamp includes a lampshade, a light source, a light pervious cover and a camera module. The light source is configured for generating light. The light pervious cover is mounted on the lampshade. A receiving space is defined between the light pervious cover and the lampshade. The light source is received in the receiving space. The lampshade is configured for shielding the light source and directing the light emitted from the light source to illuminate an object. The camera module is received in the receiving space. The camera module includes a lens facing the light pervious cover. The camera module is configured for capturing an image of the object illuminated by the light.

14 Claims, 2 Drawing Sheets

STREET LAMP

BACKGROUND

1. Field of the Invention

The present invention relates generally to a street lamp, and particularly to a street lamp with a surveillance function.

2. Description of Related Art

Street lamps are used to illuminate streets for road safety and security purposes. However, the street lamps typically don't have surveillance function for monitoring the activities on the streets. At present, the camera modules are widely used in surveillance systems. In the surveillance systems, the camera modules are generally disposed uncovered/unsheltered in trees or on roofs of buildings. Such camera modules may be damaged when water enters therein.

What is needed, therefore, is a street lamp with a surveillance function.

SUMMARY

A street lamp includes a lampshade, a light source, a light pervious cover and a camera module. The light source is configured for generating light. The light pervious cover is mounted on the lampshade. A receiving space is defined between the light pervious cover and the lampshade. The light source is received in the receiving space. The lampshade is configured for shielding the light source and directing the light emitted from the light source to illuminate an object. The camera module is received in the receiving space. The camera module includes a lens facing the light pervious cover. The camera module is configured for capturing an image of the object illuminated by the light.

Other advantages and novel features of the present invention will be drawn from the following detailed description of a preferred embodiment of the present invention with attached drawings.

BRIEF DESCRIPTION OF THE DRAWINGS

Many aspects of the present street lamp can be better understood with reference to the following drawings. The components in the drawing are not necessarily drawn to scale, the emphasis instead being placed upon clearly illustrating the principles of the present street lamp. Moreover, in the drawings, like reference numerals designate corresponding parts throughout the several views.

DETAILED DESCRIPTION OF THE EMBODIMENT

Figure 1:
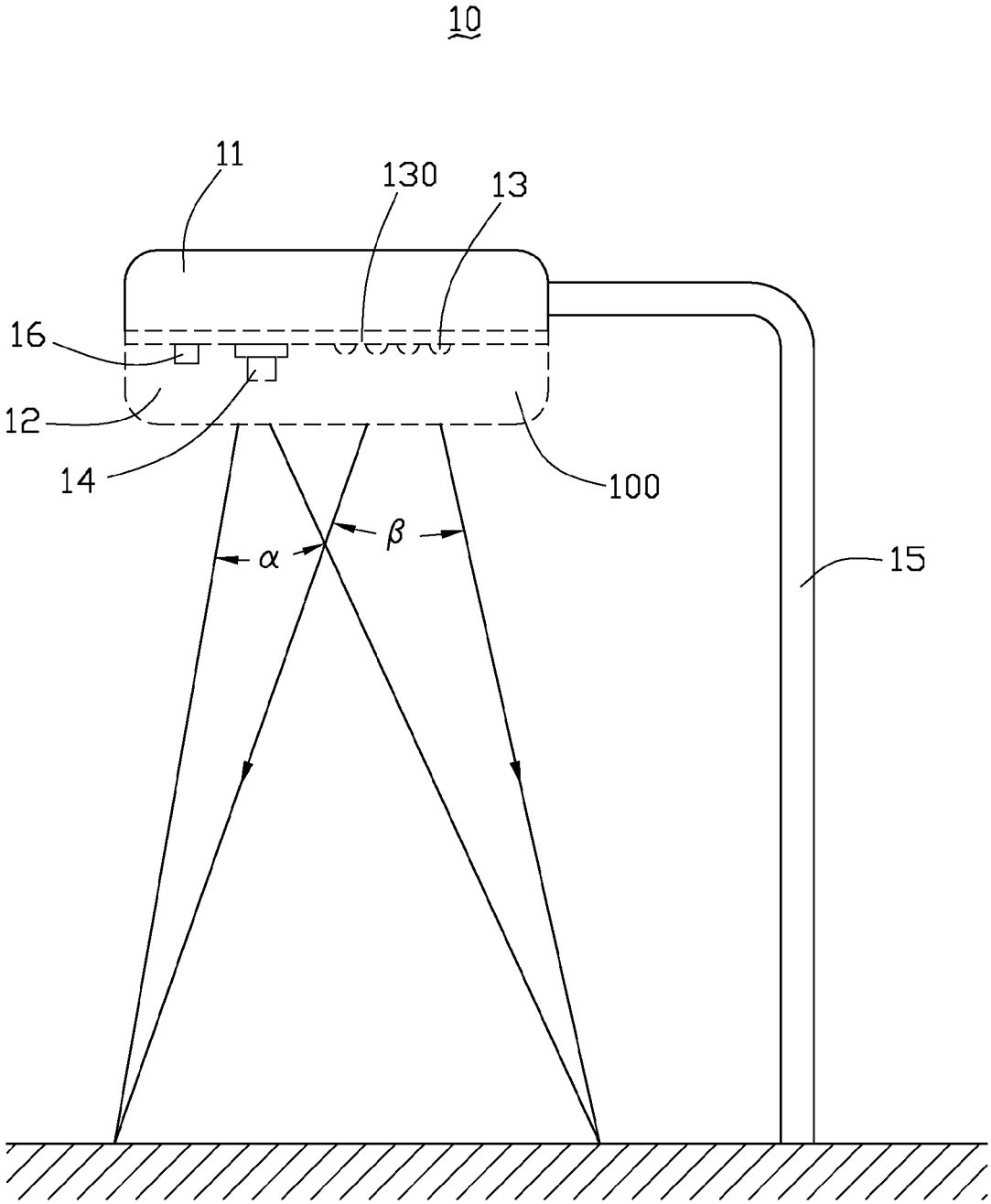
FIG. 1 is schematic, side view of a street lamp in accordance with an exemplary embodiment, wherein the street lamp includes a camera module.

The detailed explanation of a street lamp according to an exemplary embodiment will now be made with reference to the drawings attached hereto. Referring to FIG. 1, the street lamp 10 includes a lampshade 11, a light pervious cover 12, a light source 13, a camera module 14, and a lamppost 15.

The light pervious cover 12 is mounted on the lampshade 11, and a receiving space 100 is defined between the light pervious cover 12 and the lampshade 11. The street lamp 10 further includes a printed circuit board 130. The printed circuit board 130 is attached to the lampshade 11 and faces the light pervious cover 12. The light source 13 and the camera module 14 are mounted on the printed circuit board 130. The camera module 14 is arranged adjacent to the light source 13.

In this embodiment, the light source 13 include a plurality of LEDs (light emitting diodes). Alternatively, the light source 13 may include incandescent lamps and fluorescent lamps.

The light pervious cover 12 is light-permeable. The light beams emitted from the light source 13 are transmitted through the light pervious cover 12 to illuminate the street. A material of the light pervious cover 12 can be selected from an anti-reflective material, such as light-permeable plastic. The light-permeable plastic can prevent the camera module 14 from interference by the light beams reflected within the light pervious cover 12 when the camera module 14 picks up an image of the street. The light-permeable plastic may be selected from the group consisting of polymethyl methacrylate (PMMA), poly carbonate (PC), silicone, epoxy, and polyacrylate. Alternatively, the material of the light pervious cover 12 can be glass doped with ZnO, $B_2O_3$, $SiO_2$, $Nb_2O_5$ or $Na_2O$. The light pervious cover 12 made of the above materials is lightweight, and is convenient for assembling and disassembling.

Figure 2:
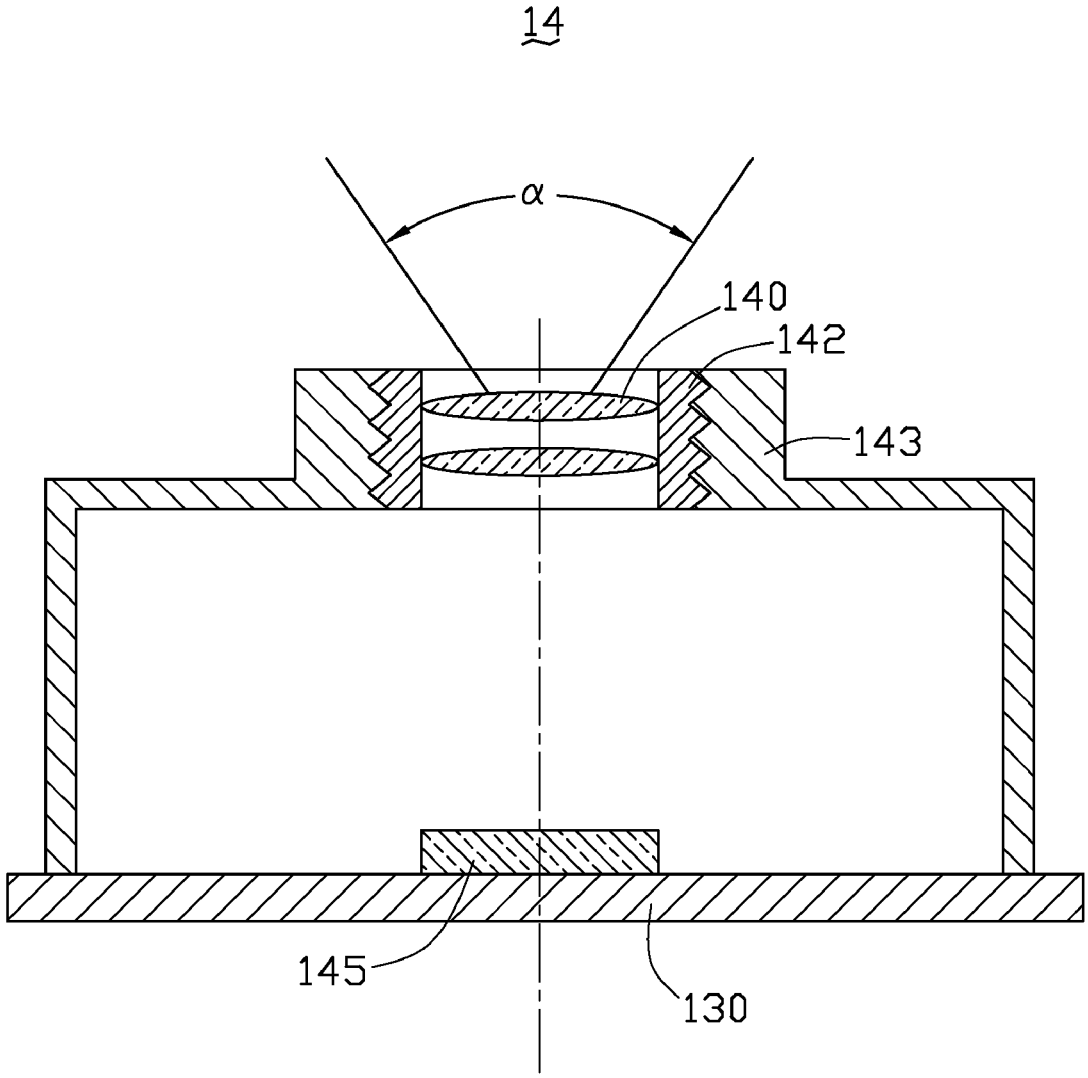
FIG. 2 is a cross-sectional view of the camera module used in the street lamp shown in FIG. 1.

Referring to FIG. 2, the camera module 14 includes a lens group 140, a lens barrel 142, a holder 143 and an image sensor 145. In this embodiment, the lens group 140 includes two lenses. The lens group 140 is mounted in the lens barrel 142. The holder 143 is mounted on the printed circuit board 130. The image sensor 145 is attached to and electrically connected with the printed circuit board 130. The image sensor 145 is faces the lens group 140. The lens barrel 142 is threadedly engaged with the holder 143 so that the lens group 140 can move towards and away from the image sensor 145. Thus, a position of focus of the lens group 140 can be adjusted.

The camera module 14 is configured for capturing the image of the street. The camera module 14 can be wire or wireless connected with sectors of government authorities, e.g. a traffic police. Thus, government authorities can monitor activities on the street via the camera module 14 of the street lamp 10. When an accident happens, the traffic police can get the street information and take action in the accident in time. The image sensor 145 can be a charged coupled device (CCD) or a complementary metal-oxide-semiconductor (CMOS).

The lamppost 15 has two end portions. One end portion of the lamppost 15 is connected to the lampshade 11, and the other end portion is fixedly mounted on the ground.

In use, the camera module 14 of the street lamp 10 can capture images of the people and cars on the street in both bright and dark environments. In a dark environment, the light source 13 illuminates the street; thus allowing the camera module 14 can clearly capture images of people and cars on the street.

The light source 13 has an illumination range $\beta$ defined by a spatial extension which the light beams emitted by the light source 13 can reach. The camera module 14 has an image field $\alpha$ which the camera module 14 can pick up. The image field $\alpha$ of the camera module 14 overlaps the illumination range $\beta$ of the light source 13. Thus the camera module 14 can capture images of the area which the light source 13 illuminates. The light beams emitted by the light source 13 need to have a high brightness in a bad weather, for example in foggy weather. Therefore, a power rating of the light source 13 is preferably larger than 100 watts.

The street lamp 10 further includes a control unit 16 electrically connected with the camera module 14. The control unit 16 is configured for controlling the camera module 14 to pick up images. In the exemplary embodiment, the control unit 16 is a clock generator for controlling the camera module 14 to pick up images at given intervals of time.

In this embodiment, the camera module 14 can be used to monitor activities on the street even in a dark environment or in bad weather. In addition, the camera module 14 is received in the receiving space 100 defined by the light pervious cover 12 and the lampshade 11. Therefore, the camera module 14 is well shielded against rain and other contingencies such as accidents increasing the life span thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A street lamp, comprising:

a lampshade;

a light source for generating light;

a light pervious cover mounted on the lampshade, a receiving space being defined between the light pervious cover and the lampshade, the light source being received in the receiving space, the lampshade being configured for shielding the light source and directing the light emitted from the light source to illuminate an object;

a camera module received in the receiving space, the camera module comprising a lens facing the light pervious cover, the camera module being configured for capturing an image of the object illuminated by the light; and a control unit comprising a clock generator, the clock generator configured for controlling the camera module to capture images at given intervals of time.

2. The street lamp of claim 1, further comprising a printed circuit board mounted in the receiving space, the camera module and the light source being electrically connected to the printed circuit board.

3. The street lamp of claim 1, wherein the light source comprises a plurality of light emitting diodes.

4. The street lamp of claim 3, wherein a power rating of the light source is larger than 100 watts.

5. The street lamp of claim 1, wherein a material of the light pervious cover is light-permeable plastic.

6. The street lamp of claim 5, wherein the light-permeable plastic is selected from the group consisting of polymethyl methacrylate (PMMA), polycarbonate (PC), silicone, epoxy and polyacrylate.

7. The street lamp of claim 1, wherein a material of the light pervious cover is glass doped with ZnO, $B_2O_3$, $SiO_2$, $Nb_2O_5$ or $Na_2O$.

8. A street lamp, comprising:

a lampshade;

a light source for generating light;

a light pervious cover mounted on the lampshade, the light pervious cover and the lampshade cooperatively forming a receiving space for receiving the light source, and the light pervious cover configured for emission of the light to a traffic lane;

a camera module received in the receiving space and connected to a traffic surveillance system, the camera module configured for capturing an image of the traffic lane illuminated by the light and sending the image to the traffic surveillance system such that the traffic surveillance system can monitor a traffic situation of the traffic lane based on the image; and a control unit comprising a clock generator, the clock generator configured for controlling the camera module to capture images at given intervals of time.

9. The street lamp of claim 8, further comprising a printed circuit board mounted in the receiving space, the camera module and the light source being electrically connected to the printed circuit board.

10. The street lamp of claim 8, wherein the light source comprises a plurality of light emitting diodes.

11. The street lamp of claim 10, wherein a power rating of the light source is larger than 100 watts.

12. The street lamp of claim 8, wherein a material of the light pervious cover is light-permeable plastic.

13. The street lamp of claim 12, wherein the light-permeable plastic is selected from the group consisting of polymethyl methacrylate (PMMA), polycarbonate (PC), silicone, epoxy and polyacrylate.

14. The street lamp of claim 8, wherein a material of the light pervious cover is glass doped with an item selected from the group consisting of ZnO, $B_2O_3$, $SiO_2$, $Nb_2O_5$ and $Na_2O$.

* * * * *